US011466706B2

(12) United States Patent
Fujiwara et al.

(10) Patent No.: US 11,466,706 B2
(45) Date of Patent: Oct. 11, 2022

(54) VALVE DEVICE

(71) Applicant: KAWASAKI JUKOGYO KABUSHIKI KAISHA, Kobe (JP)

(72) Inventors: Hiroaki Fujiwara, Kobe (JP); Noboru Ito, Kobe (JP); Hiroshi Itoh, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 151 days.

(21) Appl. No.: 17/054,065

(22) PCT Filed: Apr. 23, 2019

(86) PCT No.: PCT/JP2019/017169
§ 371 (c)(1),
(2) Date: Nov. 9, 2020

(87) PCT Pub. No.: WO2019/216195
PCT Pub. Date: Nov. 14, 2019

(65) Prior Publication Data

US 2021/0239139 A1 Aug. 5, 2021

(30) Foreign Application Priority Data

May 7, 2018 (JP) ..... JP2018-089458

(51) Int. Cl.
*F16K 11/07* (2006.01)
*F15B 13/04* (2006.01)
*F15B 13/01* (2006.01)

(52) U.S. Cl.
CPC ..... *F15B 13/0402* (2013.01); *F15B 13/01* (2013.01); *F15B 2211/72* (2013.01); *Y10T 137/8671* (2015.04)

(58) Field of Classification Search
CPC ..... Y10T 137/8671; Y10T 137/86614; F15B 13/01
USPC ..... 91/447, 445
See application file for complete search history.

(56) References Cited

U.S. PATENT DOCUMENTS 4,093,002 A 6/1978 Tardy
4,417,502 A * 11/1983 Shore ..... F15B 11/003 91/452
4,782,859 A * 11/1988 Constantinian ..... F15B 13/04 137/625.68
4,958,553 A * 9/1990 Ueno ..... F15B 13/01 91/461

(Continued)

FOREIGN PATENT DOCUMENTS

EP 2 107 253 A2 10/2009
JP S54-153669 U 10/1979

(Continued)

*Primary Examiner* — Robert K Arundale
(74) *Attorney, Agent, or Firm* — Oliff PLC

(57) ABSTRACT

A valve device that changes the direction of flow of a hydraulic fluid supplied to and discharged from a cylinder mechanism to actuate the cylinder mechanism, the valve device including: a control valve including a main spool axially movable between different positions; a lock valve including a plunger and a pressure chamber; and a selector valve including a selector spool operable in conjunction with the main spool to axially move between different positions, the selector spool being located adjacent to the main spool and having an axis crossing an axis of the main spool.

6 Claims, 5 Drawing Sheets

(56) References Cited

U.S. PATENT DOCUMENTS

| | | | | |
|---|---|---|---|---|
| 6,256,986 | B1 * | 7/2001 | Langen | F15B 11/05 60/462 |
| 6,907,815 | B2 | 6/2005 | Kim | |
| 7,213,501 | B2 * | 5/2007 | Kauss | F15B 13/015 137/625.69 |

FOREIGN PATENT DOCUMENTS

| | | | |
|---|---|---|---|
| JP | H06-229402 | A | 8/1994 |
| JP | H07-139515 | A | 5/1995 |
| JP | H08-35501 | A | 2/1996 |
| JP | H09-269001 | A | 10/1997 |

* cited by examiner

VALVE DEVICE

TECHNICAL FIELD

The present invention relates to a valve device that controls flow of a hydraulic fluid supplied to a cylinder mechanism to extend and contract the cylinder mechanism and that allows a load (including a component and an attachment) mounted on the cylinder mechanism to be held in a fixed position.

BACKGROUND ART

A work machine such as a tractor or forklift includes a component and an attachment (which will be referred to as "component etc." hereinafter). The work machine raises and lowers the component etc. by a cylinder. The cylinder switches between raising and lowering of the component etc. according to the direction of flow of the hydraulic fluid supplied to the cylinder. The direction of flow of the hydraulic fluid is changed by a valve device. The valve device has the function of holding the component etc. in a fixed position when a main spool of the valve device is in a neutral position. An example of such a valve device is known from Patent Literature 1 (the valve device is referred to as "control device" in Patent Literature 1).

The control device of Patent Literature 1 includes a lock valve and a selector to hold the component etc. in a fixed position. The lock valve is located in a path between the main spool and a head-side port of the cylinder. The lock valve includes a poppet. The poppet is configured to open and close the above path. The poppet is subjected to a pilot pressure acting in such a direction as to close the path. This pilot pressure is switched between different pressures by the selector. The selector includes a selector spool and switches the pilot pressure between a tank pressure and a hydraulic pressure at the head-side port by changing the position of the selector spool. In the selector thus configured, the selector spool moves between different positions in conjunction with the main spool.

When the main spool moves to a lowering position (a position to which the main spool moves when the component etc. are lowered), the selector spool is pushed by the main spool and moved from one position to another. Thus, the tank pressure is introduced as the pilot pressure to the lock valve. The poppet is subjected to the hydraulic pressure of the hydraulic fluid to be discharged from the head-side port of the cylinder, the hydraulic pressure acting against the pilot pressure. The poppet is moved in such a direction as to open the path, and accordingly the path is opened. Thus, the hydraulic fluid is discharged from the head-side port of the cylinder. The cylinder is contracted to lower the component etc.

When the main spool moves to a neutral position or a raising position (a position to which the main spool moves when the component etc. are raised), the selector spool is returned to the initial position. Thus, the hydraulic pressure at the head-side port is introduced as the pilot pressure to the lock valve. When the main spool is in the raising position, the hydraulic fluid flows from the main spool toward the head-side port of the cylinder. The hydraulic pressure of the hydraulic fluid is applied to the poppet in such a direction as to act against the pilot pressure. Thus, the poppet is moved in such a direction as to open the path, and accordingly the path is opened. The hydraulic fluid is supplied from the main spool to the head-side port of the cylinder. As a result, the cylinder is extended to raise the component etc. When the main spool is in the neutral position, the hydraulic pressure of the hydraulic fluid to be discharged from the head-side port of the cylinder is applied to the poppet to act against the pilot pressure. However, the hydraulic pressure is low enough not to cause the poppet to move in such a direction as to open the path, and the path remains closed. Thus, discharge of the hydraulic fluid from the head-side port of the cylinder is blocked by the lock valve. As such, extension and contraction of the cylinder is inhibited. That is, the component etc. are prevented from being raised or lowered. The component etc. are held in a fixed position.

CITATION LIST

Patent Literature

PTL 1: Japanese Laid-Open Patent Application Publication No. H7-139515

SUMMARY OF INVENTION

Technical Problem

The control device of Patent Literature 1 is configured as follows in order to change the position of the selector spool in conjunction with the position of the main spool. In the control device, the selector spool has an axis generally coinciding with the axis of the main spool, and is located adjacent to the main spool. As such, when the main spool moves to the lowering position, the selector spool is pushed by the main spool and moved from one position to another. By this position change, the selector spool permits the tank pressure to be introduced as the pilot pressure.

In the control device configured as described above, the selector spool needs to be capable of moving at least the same distance as the main spool moves (in particular, the distance from the neutral position to a lowering position where the component etc. are maximally lowered). As such, the outer size of the selector is increased in the axial direction of the selector spool. Accordingly, the outer size of the control device is increased in the axial direction.

It is therefore an object of the present invention to provide a valve device the size of which can be reduced.

Solution to Problem

A valve device of the present invention is a valve device that changes a direction of flow of a hydraulic fluid supplied to and discharged from a cylinder mechanism to actuate the cylinder mechanism, the valve device including: a control valve including a main spool axially movable between different positions, the control valve being connected to the cylinder mechanism via a first supply/discharge path and a second supply/discharge path through which the hydraulic fluid is supplied to and discharged from the cylinder mechanism, the control valve being configured to, when the main spool has moved to a first position, allow the hydraulic fluid to be supplied to the cylinder mechanism through the first supply/discharge path and discharged into a tank through the second supply/discharge path, the control valve being further configured to, when the main spool has moved to a second position, allow the hydraulic fluid to be supplied to the cylinder mechanism through the second supply/discharge path and discharged into the tank through the first supply/discharge path, the control valve being further configured to, when the main spool has returned to a neutral position, block flow of the hydraulic fluid to the cylinder mechanism through the first and second supply/discharge paths; a lock valve including a plunger disposed in the first supply/discharge path to open and close the first supply/discharge path, a biasing member biasing the plunger in a closing direction in which the plunger moves to close the first supply/discharge path, and a pressure chamber into which a cylinder head pressure is introduced and which applies the cylinder head pressure to the plunger in the closing direction, wherein a hydraulic pressure of the hydraulic fluid flowing in a cylinder mechanism-side portion of the first supply/discharge path and a hydraulic pressure of the hydraulic fluid flowing in a control valve-side portion of the first supply/discharge path are applied to the plunger to act against a biasing force of the biasing member, the cylinder mechanism-side portion being a portion closer to the cylinder mechanism than the plunger, the control valve-side portion being a portion closer to the control valve than the plunger; and a selector valve including a selector spool operable in conjunction with the main spool to axially move between different positions, the selector valve being configured to, when the main spool moves to the first position or the neutral position, move the selector spool to a holding position to bring the pressure chamber into communication with the cylinder mechanism-side portion of the first supply/discharge path, the selector valve being further configured to, when the main spool moves to the second position, move the selector spool to an open position to bring the pressure chamber into communication with the tank, the selector spool being located adjacent to the main spool and having an axis crossing an axis of the main spool.

In the present invention, the selector spool is located adjacent to the main spool and has an axis crossing the axis of the main spool. As such, the increase in the length of the valve device in the axial direction of the main spool can be prevented, unlike the case of the conventional control device. Additionally, since the selector spool is located adjacent to the main spool, the increase in outer size in the direction crossing the axis of the main spool can also be prevented. Consequently, the size of the valve device can be reduced.

In the above invention, the control valve may be a pilot-operated spool valve and allow a first pilot pressure and a second pilot pressure to be applied to the main spool in such directions that the first and second pilot pressures act against each other, the main spool may move to the second position upon receiving the first pilot pressure and move to the first position upon receiving the second pilot pressure, and the selector spool may operate in conjunction with the main spool by receiving the first pilot pressure and moving to a position determined according to the first pilot pressure.

In the above configuration, the first pilot pressure is applied to the selector spool to allow the selector spool to operate in conjunction with the movement of the main spool. This eliminates the need to construct a structure in which, as in the conventional control device, an end surface of the main spool and an end surface of the selector spool face each other and are pressed together to allow the spools to operate in conjunction with each other. The valve device of this invention therefore allows for increased design flexibility of the selector spool.

In the above invention, the main spool may have an outer circumferential portion provided with a tapered portion increasing in diameter in such a direction that the selector spool is moved by the tapered portion as the main spool moves from the neutral position toward the second position, a portion of the selector spool may be adjacent to the outer circumferential portion of the main spool, the portion of the selector spool may be in contact with the tapered portion when the main spool is in the neutral position, and the tapered portion may allow the selector spool to move from the holding position to the open position when the main spool is moved from the neutral position to the second position with the portion of the selector spool in contact with the tapered portion.

In the above configuration, when the main spool is moved to the second position, the tapered portion enables the selector spool to operate in conjunction with the movement of the main spool.

In the above invention, the valve device may further include an operation lever coupled to the main spool and operated to move the main spool from the neutral position to the first position and the second position.

In the above configuration, the operation lever can be operated to move the main spool and change the direction of flow of the hydraulic fluid supplied to and discharged from the cylinder mechanism. The load can be raised and lowered by operating the operation lever. Additionally, since the tapered portion enables the selector spool to operate in conjunction with the movement of the main spool, the selector spool can be moved together with the main spool simply by operating the operation lever.

In the above invention, the main spool may be configured to, when moving from the neutral position to the second position, gradually establish a connection between the first supply/discharge path and the tank after the pressure chamber and the tank are brought into communication.

In the above configuration, when the load is lowered, the flow rate of the hydraulic fluid discharged from the first supply/discharge path into the tank can be gradually increased. Thus, the shock occurring during the lowering of the load can be reduced.

In the above invention, the selector spool may be configured to, when moving from the holding position to the open position, establish a connection between the pressure chamber and the tank after the pressure chamber and the cylinder mechanism-side portion of the first supply/discharge path are disconnected.

In the above configuration, the hydraulic fluid flowing in the first supply/discharge path can be prevented from being discharged into the tank through the selector. That is, the hydraulic fluid flowing in the first supply/discharge path can be discharged only through the control valve. This can facilitate control of the discharge flow rate of the hydraulic fluid flowing in the first supply/discharge path.

Advantageous Effects of Invention

The present invention makes it possible to reduce the size of a valve device.

DESCRIPTION OF EMBODIMENTS

Hereinafter, a valve device 1 according to an embodiment of the present invention will be described with reference to the drawings. The directions mentioned in the following description are merely used for convenience of explanation, and the directions or orientations of the elements of the invention are not limited to those mentioned below. The valve device 1 described hereinafter is merely an embodiment of the present invention. The present invention is not limited to this embodiment, and additions, deletions, and changes may be made without departing from the gist of the invention.

Figure 1:
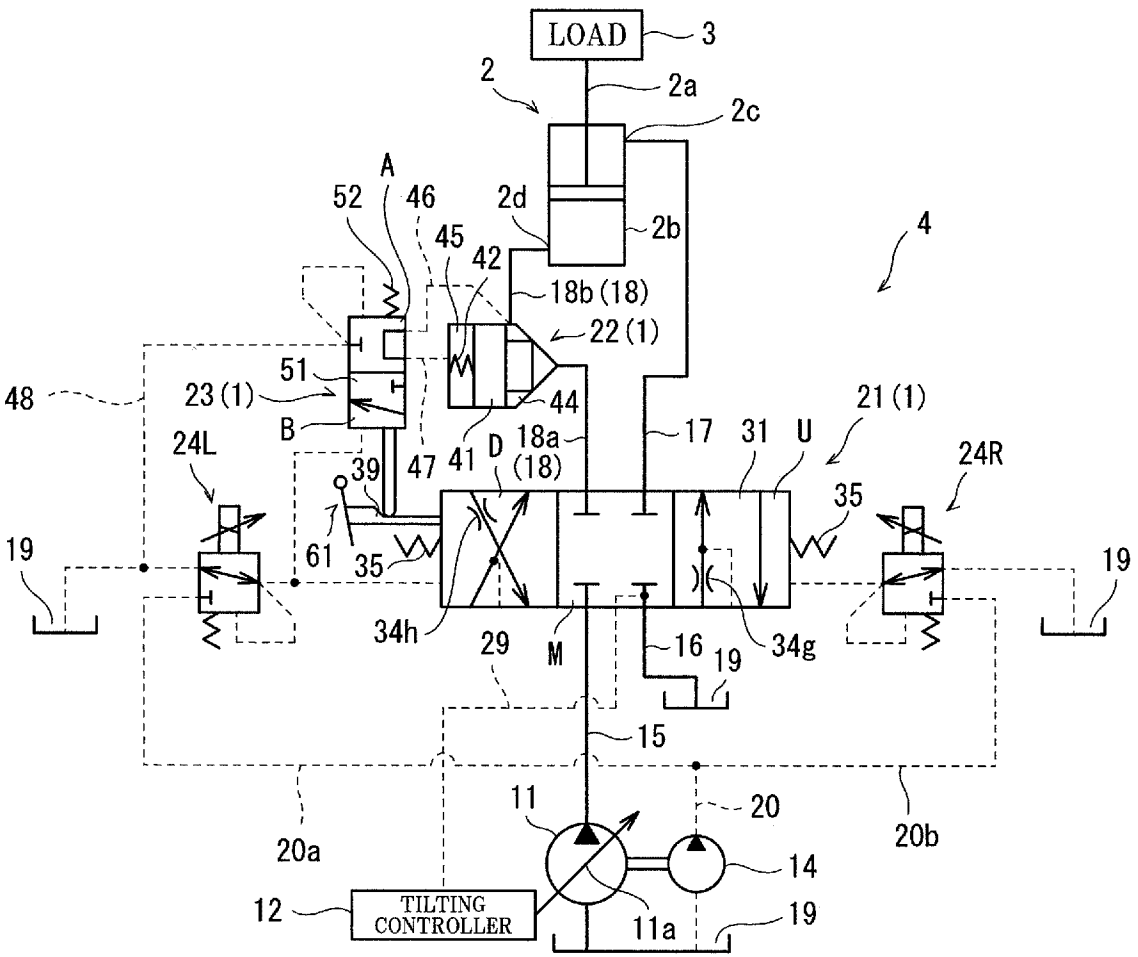
FIG. 1 is a hydraulic circuit diagram showing a hydraulic drive system including a valve device according to an embodiment of the present invention.

A work machine such as a tractor or forklift includes a component (such as a sprayer) and an attachment (such as a front loader, boom, or fork). The component and attachment will be collectively referred to as a "load 3" hereinafter. The work machine carries out various works using the load 3. During a work, the work machine may raise and lower the load 3. To raise and lower the load 3, the work machine is equipped with a cylinder mechanism 2 as shown in FIG. 1. The cylinder mechanism 2 is actuated by a hydraulic fluid (which is typically an oil and may be another fluid such as water) flowing in the cylinder mechanism 2. The cylinder mechanism 2 is extended or contracted depending on the direction of flow of the hydraulic fluid. By this extension and contraction, the cylinder mechanism 2 raises and lowers the load 3.

More specifically, the cylinder mechanism 2 includes a rod 2*a* and a cylinder 2*b*. The rod 2*a* is inserted in the cylinder 2*b* and configured to be advanced and retracted relative to the cylinder 2*b*. The cylinder 2*b* is provided with a rod-side port 2*c* and a head-side port 2*d*, through which the hydraulic fluid is supplied and discharged to actuate the rod 2*a*. When the hydraulic fluid is supplied to the rod-side port 2*c* and discharged from the head-side port 2*d*, the rod 2*a* is retracted relative to the cylinder 2*b*, so that the cylinder mechanism 2 is contracted. When the hydraulic fluid is supplied to the head-side port 2*d* and discharged from the rod-side port 2*c*, the rod 2*a* is advanced relative to the cylinder 2*b*, so that the cylinder mechanism 2 is extended. To the thus configured cylinder mechanism 2 is connected a hydraulic drive system 4 for supplying the hydraulic fluid to the cylinder mechanism 2.

As mentioned above, the hydraulic drive system 4 has the function of supplying the hydraulic fluid to the cylinder mechanism 2. The hydraulic drive system 4 includes a main pump 11, a tilting controller 12, the valve device 1, and a pilot pump 14. The main pump 11 is, for example, a swash plate pump of the variable displacement type. The main pump 11 includes a swash plate 11*a*. The main pump 11 is configured to vary the delivery capacity by changing the tilting angle of the swash plate 11*a*. The tilting controller 12 is provided to change the tilting angle of the swash plate 11*a*. The tilting controller 12 controls the tilting angle according to a load sensing pressure pL described below. The main pump 11 configured as described above is coupled to a non-illustrated prime mover such as an engine or electric motor, and pumps the hydraulic fluid at a flow rate determined according to the rotational speed of the prime mover and the delivery capacity of the pump. The hydraulic fluid thus pumped is delivered to the valve device 1 through a pump path 15 of the main pump 11.

The valve device 1 controls the flow of the hydraulic fluid supplied to the cylinder mechanism 2. The valve device 1 includes a control valve 21, a lock valve 22, and a selector 23. The control valve 21 mainly controls the flow of the hydraulic fluid pumped from the main pump 11 toward the cylinder mechanism 2. More specifically, the control valve 21 is mainly connected to the pump path 15, a tank path 16, a rod-side path 17, and a head-side path 18. The tank path 16 is connected to a tank 19. The rod-side path 17 and head-side path 18 are connected respectively to the rod-side port 2*c* and head-side port 2*d* of the cylinder mechanism 2. The control valve 21 includes a main spool 31 to change the connection relationship among the four paths 15 to 18.

The main spool 31 is movable to three positions, namely a neutral position M, a raising position U, and a lowering position D. The connection relationship among the four paths 15 to 18 differs depending on in which of the positions the main spool 31 is located. Once the main spool 31 is moved to the raising position U, the pump path 15 becomes connected to the head-side path 18, and the rod-side path 17 becomes connected to the tank path 16. Thus, the hydraulic fluid is supplied to the head-side port 2*d* and discharged from the rod-side port 2*c*. Consequently, the rod 2*a* is advanced (the cylinder mechanism 2 is extended) to raise the load 3. Once the main spool 31 is moved to the lowering position D, the pump path 15 becomes connected to the rod-side path 17, and the head-side path 18 becomes connected to the tank path 16. Thus, the hydraulic fluid is supplied to the rod-side port 2*c* and discharged from the head-side port 2*d*. Consequently, the rod 2*a* is retracted (the cylinder mechanism 2 is contracted) to lower the load 3. When the main spool 31 has been moved to the raising position U or the lowering position D, either the pressure in the head-side path 18 or the pressure in the rod-side path 17 is output as the load sensing pressure pL to the tilting controller 12 depending on the position of the main spool 31. The tilting controller 12 controls the tilting angle of the swash plate 11*a* so that the pressure in the pump path 15 is higher by a certain amount than the load sensing pressure pL. For example, when the main spool 31 moves, the opening area of a raising-side flow rate control element 34*g* is increased or decreased. To keep constant the pressure in the pump path 15, the main pump 11 pumps the hydraulic fluid at a flow rate proportional to the opening area. Thus, if the pressure in the rod-side path 17 is constant, the cylinder mechanism 2 is operated at a speed determined according to the distance moved by the main spool 31. Once the main spool 31 is returned to the neutral position M, all of the four paths 15 to 18 become disconnected from one another. Thus, supply and discharge of the hydraulic fluid to and from the cylinder mechanism 2 are inhibited, and the load 3 can be prevented from being lowered or raised. In the neutral position M, the load sensing pressure pL is the tank pressure, and the flow rate of the hydraulic fluid pumped from the main pump 11 is reduced.

Both ends of the main spool 31 having the above function respectively receive pilot pressures p1 and p2. The position to which the main spool 31 moves is determined according to the pilot pressures p1 and p2 applied to the main spool 31. Specifically, the main spool 31 moves to the lowering position D upon receiving the first pilot pressure p1 and to the raising position U upon receiving the second pilot pressure p2. When the main spool 31 receives neither of the two pilot pressures p1 and p2 or when the difference between the pilot pressures p1 and p2 is within a given range (in particular, a range determined according to the biasing force of a spring mechanism 35 described later), the main spool 31 is held in the neutral position M. The main spool 31 operable as described above is connected to the pilot pump 14 which applies the pilot pressures p1 and p2 respectively to both ends of the main spool 31.

The pilot pump 14 is, for example, a pump (e.g., a swash plate pump or gear pump) of the fixed displacement type. The pilot pump 14 is coupled to a non-illustrated prime mover such as an engine or electric motor. The pilot pump 14 pumps a pilot fluid (which is the same fluid as the hydraulic fluid and may be, for example, an oil or water) to a pilot path 20 at a flow rate determined according to the rotational speed of the prime mover. The pilot path 20 is divided into first and second branch portions 20*a* and 20*b*. The portions 20*a* and 20*b* are connected respectively to both ends of the main spool 31. A first solenoid control valve 24L is disposed in the first branch portion 20*a*. A second solenoid control valve 24R is disposed in the second branch portion 20*b*. The first and second solenoid control valves 24L and 24R control the two pilot pressures p1 and p2 according to commands from a non-illustrated control unit to adjust the position (namely, the stroke distance) of the main spool 31. In the control valve 21, the first pilot pressure p1 is output from the first solenoid control valve 24L to move the main spool 31 to the lowering position D. The second pilot pressure p2 is output from the second solenoid control valve 24R to move the main spool 31 to the raising position U. Thus, the cylinder mechanism 2 can be extended and contracted to raise and lower the load 3. Once output from the two solenoid control valves 24L and 24R is stopped, the main spool 31 is returned to the neutral position M. As a result, the movement of the load 3 is stopped. The lock valve 22 is disposed in the head-side path 18 to hold the load 3 in the position where the load 3 has stopped moving.

The lock valve 22 is configured to open and close the head-side path 18. The lock valve 22 includes a plunger 41 and a spring member 42. The plunger 41 is movable to open and close the head-side path 18. The plunger 41 is biased by the spring member 42 in a closing direction in which the plunger 41 moves to close the head-side path 18. The lock valve 22 further includes a plunger chamber 44 and a spring chamber 45. The plunger chamber 44 communicates with a head-side portion 18*b* of the head-side path 18, and the hydraulic fluid is delivered to the plunger chamber 44 from the head-side portion 18*b*. When the main spool is in the neutral position M or the raising position U, the hydraulic pressure in the plunger chamber 44 can be introduced into the spring chamber 45 in a manner described later. The pressure introduced into the spring chamber 45, i.e., the pressure in the spring chamber 45, is applied to the plunger 41 in such a direction as to close the head-side path 18. Thus, the plunger 41 is pushed by the cylinder head pressure and the biasing force in the closing direction. Additionally, the plunger 41 is subjected to the pressure in the plunger chamber 44 and the hydraulic pressure in a main spool-side portion 18*a*. This hydraulic pressure is applied to the plunger 41 in an opening direction to act against the pressure in the spring chamber 45 and the biasing force.

The lock valve 22 configured as described above opens or closes the head-side path 18 depending on the pressure in the spring chamber 45, the biasing force, the pressure in the plunger chamber 44, and the hydraulic pressure in the main spool-side portion 18*a*. With the head-side path 18 closed by the lock valve 22, the load 3 is held in a fixed position. When the load 3 is raised or lowered, the lock valve 22 opens the head-side path 18 to permit supply and discharge of the hydraulic fluid to and from the cylinder mechanism 2. In order to open or close the head-side path 18 depending on the situation, the selector 23 is provided to select the hydraulic pressure to be input to the spring chamber 45.

The selector 23 includes a selector spool 51. The selector spool 51 is movable between a communication position A and an open position B. Either the pressure in the plunger chamber 44 or the tank pressure is selected according to the position of the selector spool 51, and the selected pressure is input to the spring chamber 45 of the lock valve 22. More specifically, a biasing spring 52 is attached to a first end of the selector spool 51. The biasing spring 52 biases the selector spool 51 toward the communication position A. A second end of the selector spool 51 receives the first pilot pressure p1 acting against the biasing force of the biasing spring 52. The selector spool 51 moves between the communication position A and the open position B according to the first pilot pressure p1 and the biasing force.

In the selector 23 configured as described above, the selector spool 51 is in the communication position A when the first pilot pressure p1 is not output, namely when the main spool 31 is in the neutral position M or the raising position U. In this case, the pressure in the plunger chamber 44 is input to the pressure in the spring chamber 45. Thus, when the main spool 31 is in the neutral position M or the raising position U, the plunger 41 is pushed in the closing direction.

When the main spool 31 is in the raising position U, the hydraulic fluid pumped from the main pump 11 is delivered to the main spool-side portion 18*a*, and the hydraulic pressure of the hydraulic fluid is applied to the plunger 41 to act against the pressure in the spring chamber 45. Once the hydraulic pressure of the hydraulic fluid becomes higher than the pressure in the spring chamber 45, the plunger 41 moves in the opening direction to open the head-side path 18. Thus, the hydraulic fluid is delivered to the head-side port 2*d* through the head-side path 18, and the rod 2*a* is advanced to raise the load 3. In this case, the plunger 41 moves to a position determined according to the flow rate of the hydraulic fluid passing through the lock valve 22.

When the main spool 31 is in the neutral position M, the head-side path 18 is disconnected from all of the other paths 15 to 17, and both the head-side portion 18*b* and the main spool-side portion 18*a* have a pressure equal to the hydraulic pressure at the head-side port 2*d*. Thus, the plunger 41 is moved by the biasing force of the spring member 42 in the closing direction to close the head-side path 18. As such, discharge of the hydraulic fluid from the head-side port 2*d* into the tank path 16 or pump path 15 is prevented. The load 3 is held in a fixed position.

When the first pilot pressure p1 is output, namely when the main spool 31 is in the lowering position D, the selector spool 51 is pushed by the first pilot pressure p1 and moved to the open position B. Thus, the spring chamber 45 of the lock valve 22 becomes connected to the tank path 16 through paths 47 and 48, and the pressure in the spring chamber 45 becomes equal to the tank pressure. The plunger 41 is mainly subjected to the pressure in the plunger chamber 44 which acts against the pressure in the spring chamber 45. Thus, the plunger 41 moves in the opening direction to open the head-side path 18. In this case, the plunger 41 moves a maximum stroke distance (that is, the plunger 41 performs a full stroke). As a result, the hydraulic fluid flowing out of the head-side port 2*d* into the head-side path 18 is discharged into the tank 19 through the control valve 21 and the tank path 16, and the rod 2*a* is retracted to lower the load 3.

As described above, the valve device 1 can control the direction of flow of the hydraulic fluid to raise or lower the load 3 and hold the load 3 in the raised or lowered position. In the valve device 1 having such a function, the control valve 21, lock valve 22, and selector 23 are integrally constructed. Hereinafter, the details of the structure of the valve device 1 will be described with reference to FIG. 2.

[Structure of Valve Device]

Figure 2:
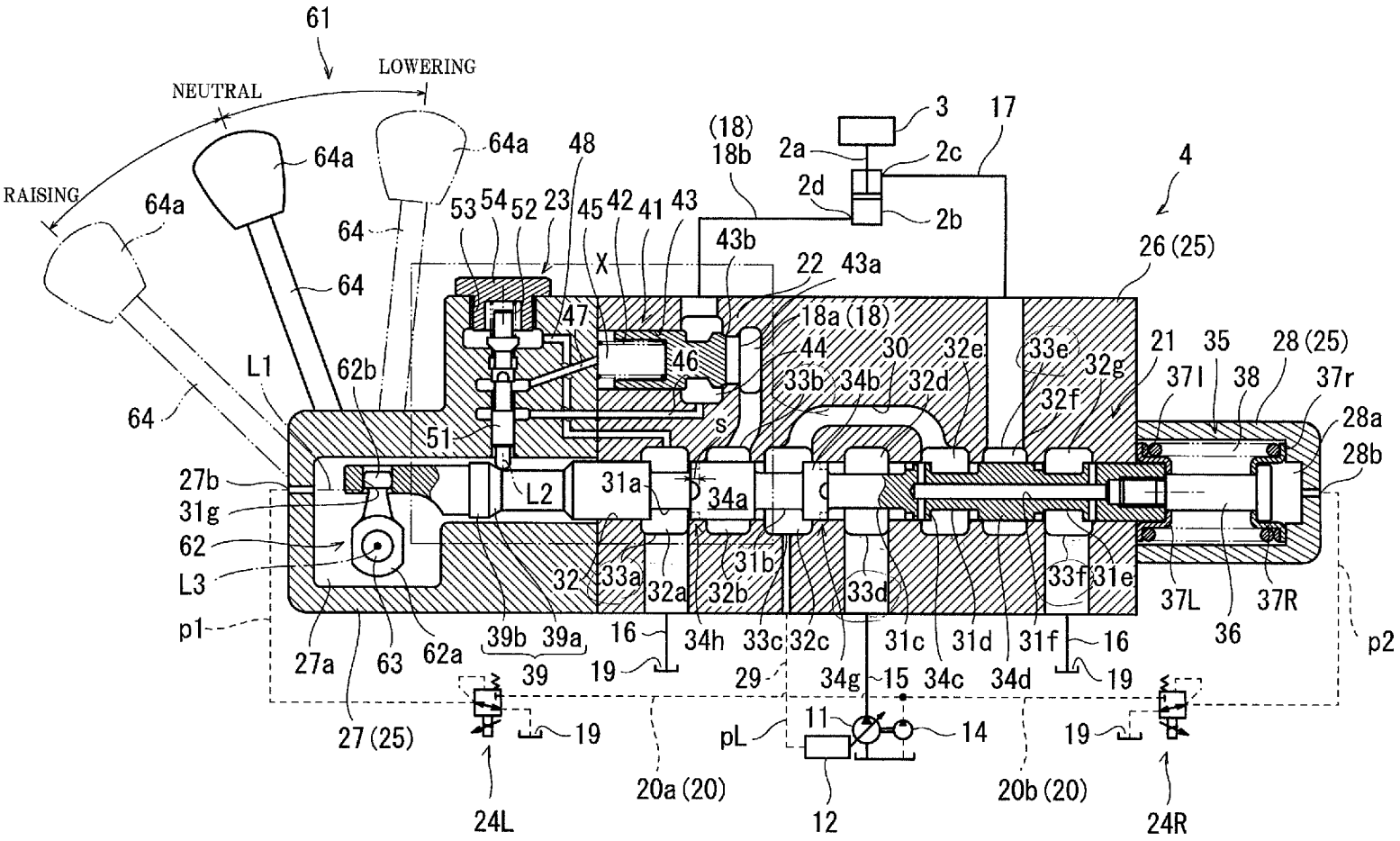
FIG. 2 is a cross-sectional view showing the structure of the valve device shown in FIG. 1.

The valve device 1 includes a housing 25, and the housing 25 can be disassembled, for example, into a housing body 26 and two covers 27 and 28. The housing body 26 is provided with a through hole 32. Referring to FIG. 2, the through hole 32 extends through the housing body 26 in the left-right direction on the sheet plane of FIG. 2. The through hole 32 includes seven larger diameter portions 32*a* to 32*g* which are larger in diameter than the rest of the through hole 32. The seven larger diameter portions 32*a* to 32*g* are arranged at intervals in the left-right direction. The housing body 26 is provided with the pump path 15, tank path 16, rod-side path 17, and head-side path 18 which have been described above, and is further provided with a load sensing path 29. The seven larger diameter portions 32*a* to 32*g* communicate with the paths 15 to 18 and 29 via ports 33*a* to 33*f*.

Specifically, among the seven larger diameter portions 32*a* to 32*g*, those other than the fifth larger diameter portion 32*e* as counted from the left, namely the six larger diameter portions 32*a* to 32*d*, 32*f*, and 32*g* are provided respectively with the ports 33*a* to 33*f*. The ports 33*a* to 33*d*, 33*f*, and 33*g* are arranged in the following order from the left: the first tank port 33*a*, the head port 33*b*, the load sensing port 33*c*, the pump port 33*d*, the rod port 33*e*, and the second tank port 33*f*. The first tank port 33*a* and the second tank port 33*f* communicate with the tank 19 via the tank path 16. The head port 33*b* communicates with the head-side port 2*d* of the cylinder mechanism 2 via the head-side path 18. The rod port 33*e* communicates with the rod-side port 2*c* via the rod-side path 17. The pump port 33*d* communicates with the main pump 11 via the pump path 15. The load sensing port 33*c* communicates with the tilting controller 12 via the load sensing path 29. The housing body 26 is further provided with a connection path 30. The fifth larger diameter portion 32*e* and the third larger diameter portion 32*c* communicate via the connection path 30. Thus, the fifth larger diameter portion 32*e* also communicates with the tilting controller 12 via the load sensing path 29. The main spool 31 is inserted in the through hole 32 formed as described above.

The main spool 31 is generally in the shape of a circular cylinder, and the axis L1 of the main spool 31 coincides with the axis of the through hole 32. The main spool 31 is inserted in the through hole 32 so as to be axially movable in opposite directions (i.e., leftward and rightward). The outer diameter of the main spool 31 (in particular, the outer diameter of portions other than annular grooves 31*a* to 31*e* described later) is generally equal to the diameter of the through hole 32 (in particular, the diameter of portions other than the larger diameter portions 32*a* to 32*g*). The main spool 31 is axially slidable along the inner circumferential surface of the housing body 26. The main spool 31 is provided with five annular grooves 31*a* to 31*e*. The annular grooves 31*a* to 31*e* are formed in a middle portion of the main spool 31 and are axially arranged at intervals. Rounds 34*a* to 34*d* are formed between the annular grooves 31*a* to 31*e* adjacent to one another. In the main spool 31 shaped as described above, the annular grooves 31*a* to 31*e* are in one-to-one correspondence with the larger diameter portions 32*a*, 32*c*, 32*d*, 32*e*, and 32*g*. A change in position of the main spool 31 provides a change in the connection relationship among the six ports 33*a* to 33*f*.

When the main spool 31 is in the neutral position M as shown in FIG. 2, the annular grooves 31*a* to 31*e* are open to the larger diameter portions 32*a*, 32*c*, 32*d*, 32*e*, and 32*g*, respectively In the through hole 32, the first round 34*a* is located between the first larger diameter portion 32*a* which is the leftmost larger diameter portion and the third larger diameter portion 32*c* as counted from the left. The first round 34*a* disconnects the first larger diameter portion 32*a* from the second larger diameter portion 32*b* and disconnects the second larger diameter portion 32*b* from the third larger diameter portion 32*c*. In the through hole 32, the second round 34*b* is located between the third larger diameter portion 32*c* and the fourth larger diameter portion 32*d* (as counted from the left) which is adjacent to and to the right of the third larger diameter portion 32*c*. The second round 34*b* disconnects the third larger diameter portion 32*c* from the fourth larger diameter portion 32*d*. In the through hole 32, the third round 34*c* is located between the fourth larger diameter portion 32*d* and the fifth larger diameter portion 32*e* (as counted from the left) which is adjacent to and to the right of the fourth larger diameter portion 32*d*. The third round 34*c* disconnects the fourth larger diameter portion 32*d* from the fifth larger diameter portion 32*e*. In the through hole 32, the fourth round 34*d* is located between the fifth larger diameter portion 32*e* and the seventh larger diameter portion 32*g* (as counted from the left) which is the rightmost larger diameter portion. The fourth round 34*d* disconnects the fifth larger diameter portion 32*e* from the sixth larger diameter portion 32*f* (as counted from the left) which is adjacent to and to the right of the fifth larger diameter portion 32*e*, and disconnects the sixth larger diameter portion 32*f* from the seventh larger diameter portion 32*g*. Thus, in the control valve 21, when the main spool 31 is in the neutral position M, the ports other than the load sensing port 33*c*, namely the ports 33*a*, 33*b*, 33*d*, and 33*f*, are all disconnected from one another. That is, all of the four paths 15 to 18 are disconnected from one another.

The main spool 31 is provided with an internal path 31*f* extending inside the main spool 31. The internal path 31*f* allows the seventh larger diameter portion 32*g* to communicate with the fifth larger diameter portion 32*e* and therefore allows the tank path 16 to communicate with the load sensing path 29 when the main spool 31 is in the neutral position M. Thus, when the main spool 31 is in the neutral position M, the tank pressure is introduced as the load sensing pressure pL to the tilting controller 12, and the tilting angle is at minimum. As such, when the main spool 31 is in the neutral position M, the energy consumption of the main pump 11 is reduced.

Next, the situation where the main spool 31 moves from the neutral position M to the raising position U (namely, leftward from the neutral position M in FIG. 2) will be described with reference to FIGS. 3A and 3B. Once the main spool 31 moves to the raising position U, the second larger diameter portion 32*b* and the third larger diameter portion 32*c*, which were disconnected by the first round 34*a*, are brought into communication. Further, the third larger diameter portion 32*c* and the fourth larger diameter portion 32*d*, which were disconnected by the second round 34*b*, are brought into communication. Additionally, the sixth larger diameter portion 32*f* and the seventh larger diameter portion 32*g*, which were disconnected by the fourth round 34*d*, are also brought into communication. Meanwhile, the internal path 31*f*, which was in communication with the fifth larger diameter portion 32*e* and the seventh larger diameter portion 32*g*, is closed. Thus, the fifth larger diameter portion 32*e* and the seventh larger diameter portion 32*g* become disconnected from each other. The connection relationship among the larger diameter portions 32*b* to 32*g* is changed in the above manner, and thus the pump port 33*d* is brought into communication with the head port 33*b* and the load sensing port 33*c*. The rod port 33*e* is brought into communication with the second tank port 33*f*. Thus, the main pump 11 is brought into communication with the head-side port 2 of the cylinder mechanism 2*d* via the control valve 21, and the rod-side port 2*c* of the cylinder mechanism 2 is brought into communication with the tank 19 via the control valve 21. As a result, the rod 2*a* is advanced to raise the load 3. In this case, the cross-sectional area of the path between the rod port 33*e* and the second tank port 33*f* and the cross-sectional area of the path between the pump port 33*d* and the head port 33*b* are controlled to opening areas determined according to the stroke distance of the main spool 31. Thus, the flow rate of the hydraulic fluid supplied to and discharged from the cylinder mechanism 2 are controlled according to the stroke distance of the main spool 31. As such, the speed at which the rod 2*a* is raised can be controlled.

The second round 34*b* is provided with a raising-side flow rate control element 34*g*. The raising-side flow rate control element 34*g* is constituted by a plurality of cuts. In the present embodiment, the raising-side flow rate control element 34*g* is constituted by four cuts. The four cuts are formed at an end of the second round 34*b* facing the fourth larger diameter portion 32*d*, and are arranged along the outer circumference of that end of the second round 34 at regular intervals. The four cuts extend toward the third larger diameter portion 32*c*. In the neutral position M, the four cuts are located between the third larger diameter portion 32*c* and the fourth larger diameter portion 32*d* and are closed. Once the main spool 31 is moved from the neutral position M to the raising position U, the four cuts are brought into communication with the third larger diameter portion 32*c*. Thus, the hydraulic fluid flowing into the fourth larger diameter portion 32*d* is delivered to the third larger diameter portion 32*c* through the four cuts. As such, the raising-side flow rate control element 34*g* can restrict the flow rate of the hydraulic fluid in the early stage of the process in which the hydraulic fluid flowing from the main pump 11 is delivered to the third larger diameter portion 32*c* through the fourth larger diameter portion 32*d*. The raising-side flow rate control element 34*g* can reduce the shock occurring at the beginning of the raising of the load.

Hereinafter, the situation where the main spool 31 moves from the neutral position M to the lowering position D (namely, rightward from the neutral position in FIG. 2) will be described with reference to FIG. 3B. Once the main spool 31 moves to the lowering position D, the first larger diameter portion 32*a* and the second larger diameter portion 32*b*, which were disconnected by the first round 34*a*, are brought into communication. Further, the fourth larger diameter portion 32*d* and the fifth larger diameter portion 32*e*, which were disconnected by the third round 34*c*, are brought into communication. Additionally, the fifth larger diameter portion 32*e* and the sixth larger diameter portion 32*f*, which were disconnected by the fourth round 34*d*, are also brought into communication. The internal path 31*f* is closed as in the case of the movement to the raising position U. Thus, the fifth larger diameter portion 32*e* and the seventh larger diameter portion 32*g* become disconnected. The connection relationship among the larger diameter portions 32*a* to 32*g* is changed in the above manner, and the head port 33*b* is brought into communication with the first tank port 33*a*. The pump port 33*d* is brought into communication with the load sensing port 33*c* and the rod port 33*e*. Thus, the main pump 11 is brought into communication with the rod-side port 2*c* of the cylinder mechanism 2 via the control valve 21, and the head-side port 2*d* of the cylinder mechanism 2 is brought into communication with the tank 19 via the control valve 21. As a result, the rod 2*a* is retracted to lower the load 3. In this case, the cross-sectional area of the path between the head port 33*b* and the first tank port 33*a* and the cross-sectional area of the path between the pump port 33*d* and the rod port 33*e* are controlled to opening areas determined according to the stroke distance of the main spool 31. Thus, the flow rate of the hydraulic fluid supplied to and discharged from the cylinder mechanism 2 are controlled according to the stroke distance of the main spool 31. As such, the speed at which the rod 2*a* is lowered can be controlled.

The first round 34*a* is provided with a lowering-side flow rate control element 34*h*. The lowering-side flow rate control element 34*h* is constituted by a plurality of cuts. In the present embodiment, the lowering-side flow rate control element 34*h* is constituted by four cuts. The four cuts are formed at an end of the first round 34*a* facing the first larger diameter portion 32*a*, and are arranged along the outer circumference of that end of the first round 34*a* at regular intervals. The four cuts extend toward the second larger diameter portion 32*b*. In the neutral position M, the four cuts are located between the first larger diameter portion 32*a* and the second larger diameter portion 32*b* and are closed. Once the main spool 31 is moved from the neutral position M to the lowering position D, the four cuts are brought into communication with the second larger diameter portion 32*b*. Thus, the hydraulic fluid flowing into the second larger diameter portion 32*b* is delivered to the first larger diameter portion 32*a* through the four cuts. As such, the lowering-side flow rate control element 34*h* can restrict the flow rate of the hydraulic fluid in the early stage of the process in which the hydraulic fluid flowing from the cylinder mechanism 2 is delivered to the first larger diameter portion 32*a* through the second larger diameter portion 32*b*. The lowering-side flow rate control element 34*h* can reduce the shock occurring at the beginning of the lowering of the load.

The main spool 31 configured as described above has first and second axial ends projecting outward from the housing body 26. The two covers 27 and 28 are mounted on first and second axial end surfaces of the housing body 26 to cover the first and second axial ends of the main spool 31, respectively. The spool cover 27, which is one of the covers 27 and 28, includes a first pilot chamber 27*a*. The first axial end of the main spool 31 projects into the first pilot chamber 27*a* from the housing body 26. The spool cover 27 is provided with a first pilot port 27*b* communicating with the first pilot chamber 27*a*. The first pilot port 27*b* communicates with the first branch portion 20*a* of the pilot path 20. Thus, the first pilot pressure p1 output from the first solenoid control valve 24L is introduced into the first pilot chamber 27*a* through the first pilot port 27*b*. By this introduction of the first pilot pressure p1 into the first pilot chamber 27*a*, the main spool 31 can be pushed and moved to the lowering position D.

The spring cover 28, which is the other of the two covers 27 and 28, is generally in the shape of a cylindrical tube. The spring cover 28 has an opening facing one of the axial end surfaces of the housing body 26 and is fixed to that axial end surface of the housing body 26. The spring cover 28 disposed in this manner includes a second pilot chamber 28*a*. The second axial end of the main spool 31 projects into the second pilot chamber 28*a* from the housing body 26. The spring cover 28 is provided with a second pilot port 28*b* communicating with the second pilot chamber 28*a*. Further, the second pilot port 28*b* communicates with the second branch portion 20*b* of the pilot path 20. Thus, the second pilot pressure p2 output from the second solenoid control valve 24R is introduced into the second pilot chamber 28*a* through the second pilot port 28*b*. By this introduction of the second pilot pressure p2 into the second pilot chamber 28*a*, the main spool 31 can be pushed and moved to the raising position U. The second pilot chamber 28*a* having the function as described above encloses a spring mechanism 35.

The spring mechanism 35 has the function of returning the main spool 31 to the neutral position M. The spring mechanism 35 includes a spacer bolt 36, a pair of spring seats 37L and 37R, and a return spring 38. The spacer bolt 36 is generally in the shape of a circular cylinder. The distal end portion of the spacer bolt 36 is threaded into an end portion (a right end portion in FIG. 2) of the main spool 31 in such a manner that the spacer bolt 36 and the main spool 31 are coaxial. The outer diameter of the spacer bolt 36 is smaller than the outer diameter of the end portion of the main spool 31, except for the proximal end portion of the spacer bolt 36. The proximal end portion of the spacer bolt 36 is larger in diameter than the rest of the spacer bolt 36. The outer diameter of the proximal end portion is generally equal to the outer diameter of the end portion of the main spool 31. That is, the middle portion of the spacer bolt 36 is smaller in diameter than the proximal end portion of the spacer bolt 36 and the end portion of the main spool 31. The pair of spring seats 37L and 37R are fitted around the middle portion.

Each of the spring seats 37L and 37R is generally in the shape of a bottomed tube. The spacer bolt 36 penetrates the bottoms of the spring seats 37L and 37R. The spring seats 37L and 37R shaped as mentioned above are fitted around the spacer bolt 36 in such a manner that their respective openings face in opposite directions (i.e., leftward and rightward) and that they are spaced from each other in the left-right direction. The inner diameter of each of the spring seats 37L and 37R is larger than the outer diameter of the end portion of the main spool 31 and the outer diameter of the proximal end portion of the spacer bolt 36. The spring seats 37L and 38R are axially spaced from each other; the spring seat 37L is mounted around the end portion of the main spool 31, while the spring seat 37R encloses the proximal end portion of the spacer bolt 36.

Each of the spring seats 37L and 37R includes a flange 371 or 37*r* located around the open end portion of the seat and extending over the entire circumference of the open end portion. The flanges 371 and 37*r* project radially outward from the open end portions. The flanges 371 and 37*r* face each other in the left-right direction when the spring seats 37L and 37R are fitted around the spacer bolt 36. The return spring 38 is located between the two flanges 371 and 37*r* facing each other. The return spring 38 is a so-called compression coil spring, and biases the spring seats 37L and 37R in opposite directions. The spring seat 37L is biased toward the end portion of the main spool 31. The spring seat 37R is biased toward the proximal end of the spacer bolt 36.

The spring mechanism 35 configured as described above is enclosed in the second pilot chamber 28*a* in such a manner that when the main spool 31 is in the neutral position M, the flange 371 is in contact with the second axial end surface of the housing body 26 and the flange 37*r* is in contact with the bottom surface of the spring cover 28. Thus, when the main spool 31 is moved to the lowering position D or the raising position U, the return spring 38 exerts a biasing force acting so as to return the main spool 31 to the neutral position M.

As previously stated, the control valve 21 outputs the pilot pressures p1 and p2 from the two solenoid control valves 24L and 24R (or produces a difference between the two pilot pressures p1 and p2) to allow the main spool 31 to move to the lowering position D and the raising position U. Once output of the pilot pressures is stopped, the main spool 31 can be returned to the neutral position M by the biasing force of the spring mechanism 35. The control valve 21 can move the main spool 31 to the lowering position D and the raising position U to permit the hydraulic fluid to be supplied to and discharged from the cylinder mechanism 2 through the head-side path 18, thereby advancing and retracting the rod 2*a* of the cylinder mechanism 2. Once the main spool 31 is returned to the neutral position M, supply and discharge of the hydraulic fluid to and from the cylinder mechanism 2 are stopped, and thus the movement of the rod 2*a* of the cylinder mechanism 2 is stopped. As previously stated, the lock valve 22 is disposed in the head-side path 18 to hold the rod 2*a* in the position where the rod 2*a* has stopped moving. The housing body 26 is provided with a valve hole 43 to dispose the lock valve 22 in the head-side path 18.

Figure 4:
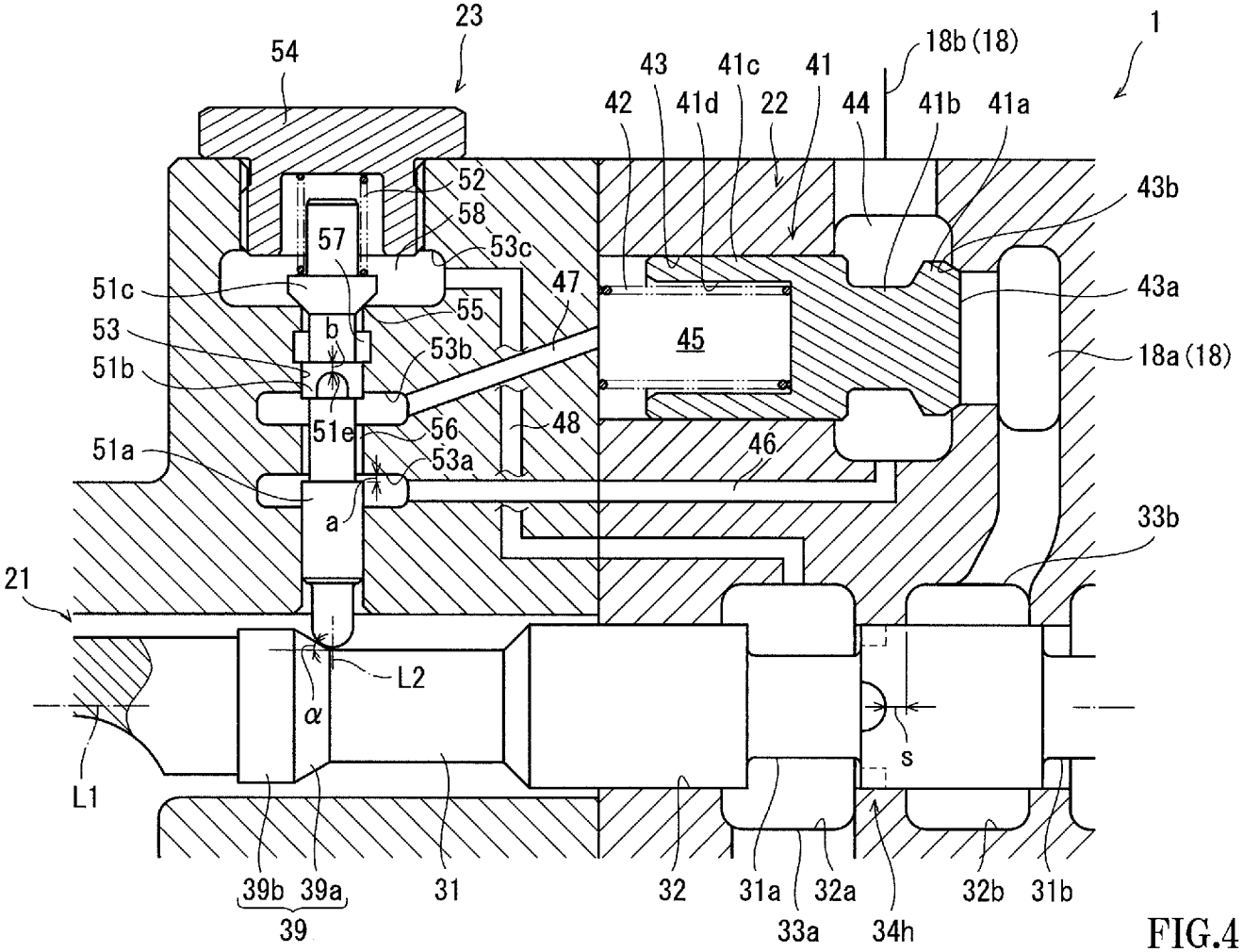
FIG. 4 is an enlarged cross-sectional view showing a region X of the valve device of FIG. 2 in an enlarged manner.

As seen from FIG. 4, the valve hole 43 is a bottomed hole having a circular cross-section and extending from the first axial end surface of the housing body 26 toward the second axial end surface of the housing body 26 (namely, the valve hole 43 extends in the axial direction). The valve hole 43 may be formed to extend in a direction crossing the axial direction. The valve hole 43 shaped as mentioned above is formed in the housing body 26 in such a manner as to be located in the head-side path 18. More specifically, the valve hole 43 communicates at its bottom with the main spool-side portion 18*a* of the head-side path 18 via a lock valve port 43*a*, and communicates at its side surface with the head-side portion 18*b*. The portion of the valve hole 43 that communicates with the main spool-side portion 18*a* is larger in diameter than the rest of the valve hole 43. The larger diameter portion forms the plunger chamber 44. The diameter of the lock valve port 43*a* is smaller than the diameter of the valve hole 43. Thus, a valve seat 43*b* is formed around the lock valve port 43*a*, and the plunger 41 inserted into the valve hole 43 is seated on the valve seat 43*b*.

The plunger 41 is generally in the shape of a bottomed cylindrical tube. The plunger 41 is inserted into the valve hole 43 so as to be axially movable. The plunger 41 includes a distal end portion 41*a*, a middle portion 41*b*, and a proximal end portion 41*c*, and these portions have different outer diameters. In the plunger 41, for example, the middle portion 41*b* has the smallest diameter. The proximal end portion 41*c* has the largest diameter. That is, the distal end portion 41*a* is larger in diameter than the middle portion 41*b*, and smaller in diameter than the proximal end portion 41*c*. The distal end portion 41*a* of the plunger 41 is configured to be fitted in the lock valve port 43*a*. By being fitted in the lock valve port 43*a*, the distal end portion 41*a* is seated on the valve seat 43*b* and closes the lock valve port 43*a*. That is, the distal end portion 41*a* is formed to close the head-side path 18. The middle portion 41*b* of the plunger 41 is located in correspondence with the plunger chamber 44. The outer diameter of the proximal end portion 41*c* is generally equal to the inner diameter of the valve hole 43 (except for the plunger chamber 44). Thus, the plunger 41 is inserted in the valve hole 43 in such a manner that the proximal end portion 41*c* provides sealing between the plunger 41 and the valve hole 43. The proximal end portion 41*c* divides the valve hole 43 into the plunger chamber 44 and the spring chamber 45. The proximal end portion 41*c* has an internal hole 41*d* opening at the proximal end. The internal hole 41*d* encloses the spring member 42.

The spring member 42 is a so-called compression coil spring. The spring member 42 is inserted in the internal hole 41*d*, and a first end portion of the spring member 42 projects from the internal hole 41*d*. The end surface of the first end portion (i.e., a first end surface) of the spring member 42 is in contact with an end surface of the spool cover 27. The spring member 42 is enclosed in the spring chamber 45 and located between the plunger 41 and the spool cover 27. The spring member 42 thus enclosed biases the plunger 41 toward the valve seat 43*b*. The plunger 41 biased is seated on the valve seat 43*b* and closes the head-side path 18.

In the lock valve 22 configured as described above, loads are applied to the plunger 41 as follows. The proximal end portion 41*c* of the plunger 41 is subjected to a load applied from the hydraulic fluid in the plunger chamber 44 and acting to move the plunger 41 in the opening direction. The distal end portion 41*a* of the plunger 41 is subjected to a load applied from the hydraulic fluid in the plunger chamber 44 and acting to move the plunger 41 in the closing direction. The "opening direction" is a direction in which the plunger 41 moves away from the valve seat 43*b*, and the "closing direction" is a direction in which the plunger 41 moves toward the valve seat 43*b*; that is, the closing direction is opposite to the opening direction. The loads applied to the proximal end portion 41*c* and the distal end portion 41*a* are proportional to the respective cross-sectional areas of these portions. Since the diameter of the lock valve port 43*a* is smaller than the outer diameter of the proximal end portion 41*c*, the proximal end portion 41*c* is subjected to a greater load than the distal end portion 41*a*. Thus, as a whole, the plunger 41 is subjected to a load applied from the hydraulic fluid in the plunger chamber 44 and acting in the opening direction. To resist the load acting in the opening direction, the pressure in the plunger chamber 44 can be introduced into the spring chamber 45. For the pressure in the plunger chamber 44 to be introduced into the spring chamber 45, the housing 25 is provided with a plunger chamber communication path 46 and a spring chamber communication path 47.

The plunger chamber communication path 46 communicates with the plunger chamber 44. The spring chamber communication path 47 communicates with the spring chamber 45. The plunger chamber communication path 46 and the spring chamber communication path 47 are connected to each other via the selector 23. The hydraulic fluid flowing through the plunger chamber communication path 46 and therefore the hydraulic fluid flowing through the head-side portion 18*b* can be delivered to the spring chamber communication path 47 through the selector 23 and flow into the spring chamber 45. The selector 23 is connected also to the tank 19 via a tank communication path 48. The entity to which the spring chamber communication path 47 is connected can be switched by the selector 23 from the plunger chamber communication path 46 to the tank 19. In other words, the selector 23 connects the spring chamber communication path 47 to either the plunger chamber communication path 46 or the tank 19. The selector 23 is configured to introduce either the pressure in the plunger chamber 44 or the tank pressure into the spring chamber 45. Hereinafter, the structure of the selector 23 will be described in detail with reference to FIG. 4.

The selector 23 is mounted in the spool cover 27. The spool cover 27 is provided with a spool hole 53 to receive the selector 23. The spool hole 53 extends in a direction generally perpendicular to the axis L1 of the main spool 31 (the up-down direction in the present embodiment). More specifically, the spool hole 53 has an opening at the upper surface of the spool cover 27 and extends down to the first pilot chamber 27*a*. The spool hole 53 formed in this manner is closed by a cap member 54 threaded into the opening of the spool hole 53. An axially middle portion of the spool hole 53 is provided with two annular grooves 53*a* and 53*b* recessed radially outward, the annular grooves 53*a* and 53*b* extending over the entire circumference of the axially middle portion of the spool hole 53. The first annular groove 53*a* communicates with the plunger chamber communication path 46. The second annular groove 53*b* communicates with the spring chamber communication path 47. The spool hole 53 formed as described above receives the selector spool 51 inserted so as to be axially movable.

The selector spool 51 is generally in the shape of a circular cylinder and includes a distal end-side portion, a middle portion, and a proximal end-side portion, which are axially arranged and are provided with rounds 51*a*, 51*b*, and 51*c*, respectively. The three rounds 51*a*, 51*b*, and 51*c* are larger in diameter than the rest of the selector spool 51. The outer diameter of the first round 51*a* of the distal end-side portion and the outer diameter of the second round 51*b* of the middle portion are generally equal to the diameter of the spool hole 53 (in particular, the diameter of the middle portion of the spool hole 53 except for the annular grooves 53*a* and 53*b*). The portion of the selector spool 51 that is between the first and second rounds 51*a* and 51*b* has a diameter smaller than the diameter of the spool hole 53. Thus, an annular path 56 is formed between the first and second rounds 51*a* and 51*b*. The annular path 56 is always in communication with the second annular groove 53*b*. The annular path 56 and the first annular groove 53*a* are connected or disconnected depending on the position of the selector spool 51.

Figure 3A:
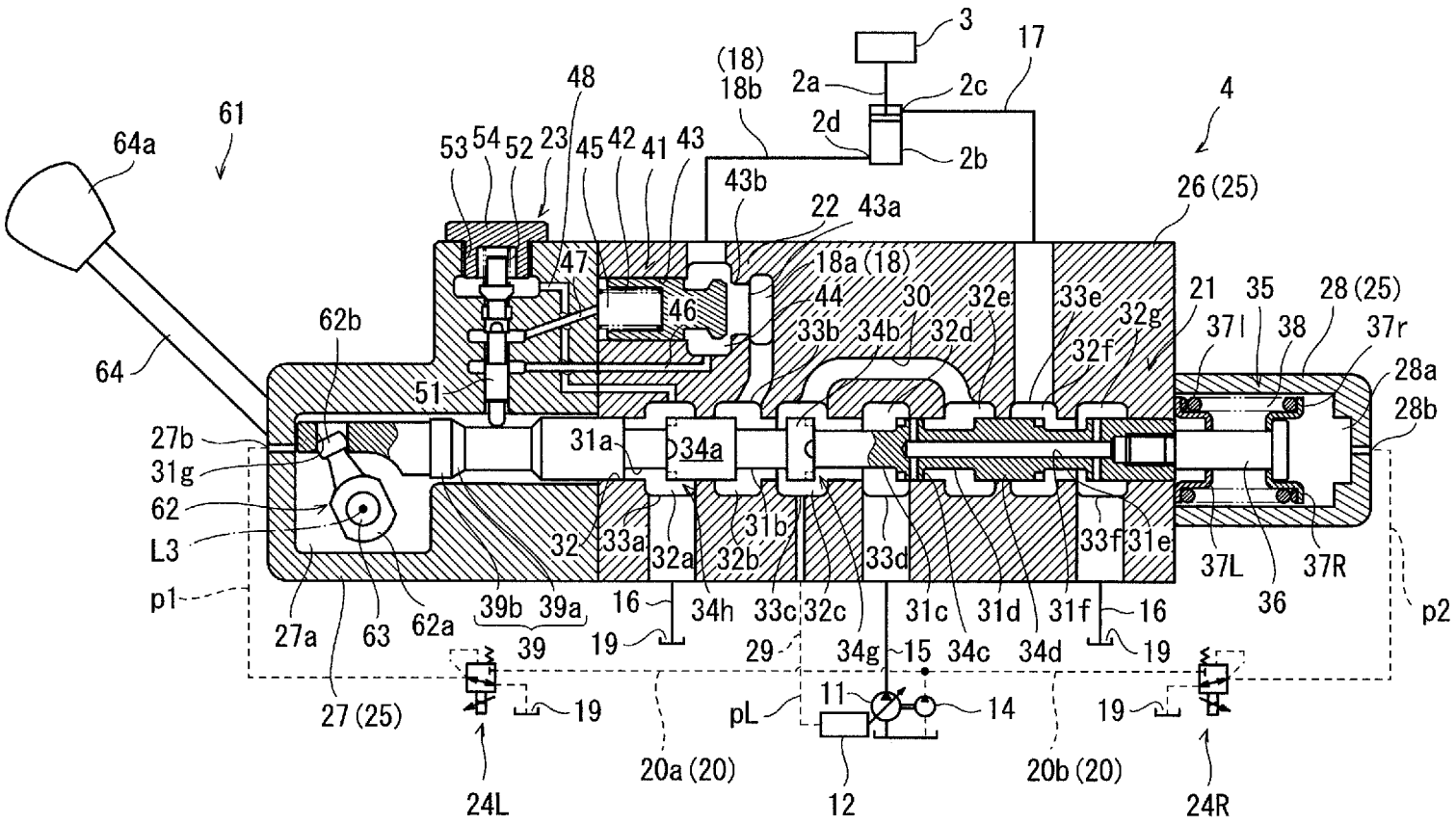
FIG. 3A is a cross-sectional view showing the valve device of FIG. 2 with an operation lever lowered.
Figure 3B:
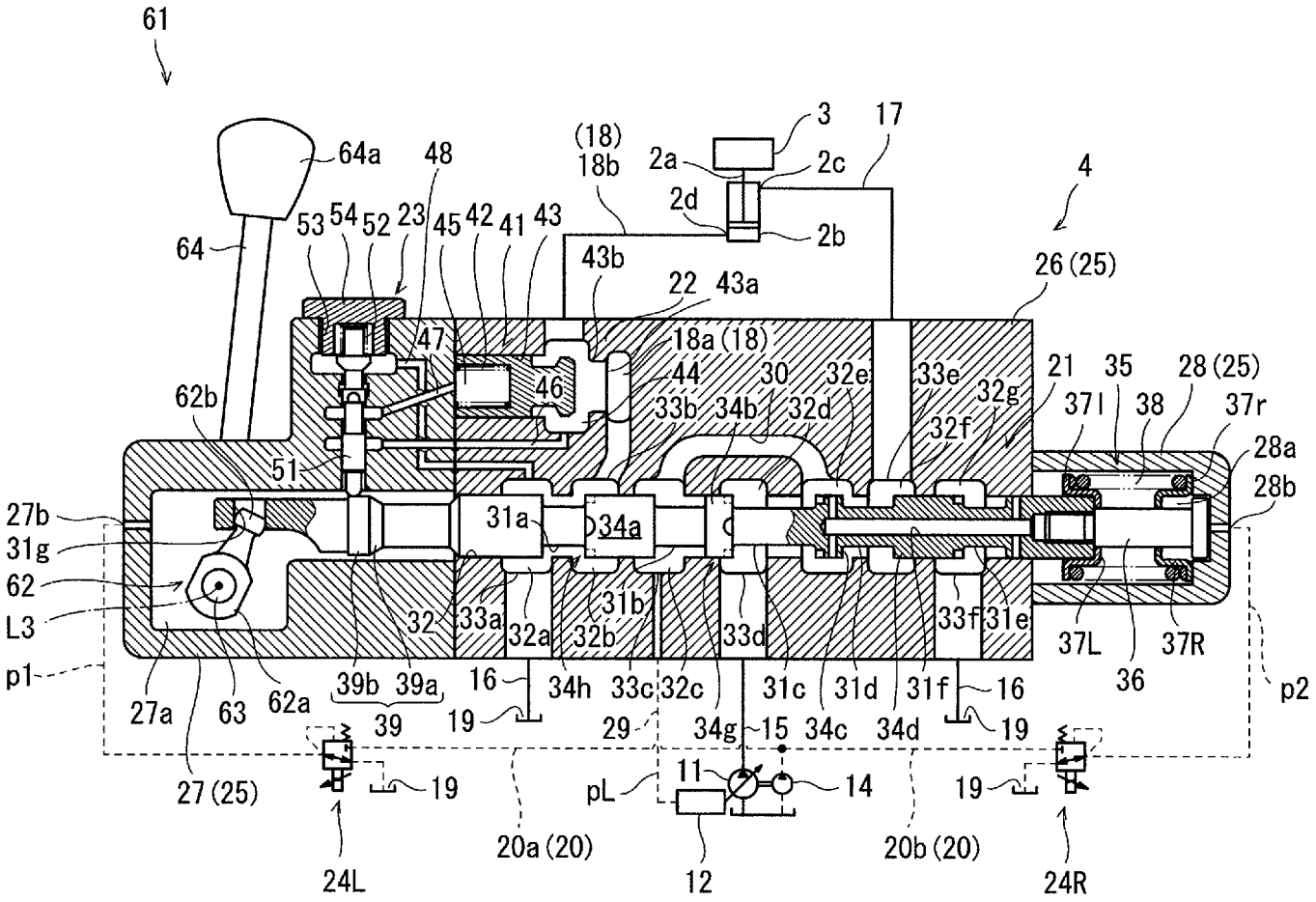
FIG. 3B is a cross-sectional view showing the valve device of FIG. 2 with the operation lever raised.

In particular, when the selector spool 51 is in the communication position A as shown in FIGS. 2 and 3A, the annular path 56 is connected to the two annular grooves 53*a* and 53*b*, which are thus in communication with each other. As such, the plunger chamber communication path 46 and the spring chamber communication path 47 are in communication, and the pressure in the plunger chamber 44 can be introduced into the spring chamber 45. Once the selector spool 51 moves a distance equal to or greater than a distance a upward from the communication position A, the first annular groove 53*a* is closed by the first round 51*a*, and the annular path 56 and the first annular groove 53*a* are disconnected. That is, the two annular grooves 53*a* and 53*b* are disconnected from each other. To introduce the tank pressure to the second annular groove 53*b* and hence to the spring chamber 45 in the disconnected state, the selector 23 is configured as described below.

The spool hole 53 is provided with an annular space 57 recessed radially outward, and this annular space 57 is located closer to the proximal end of the spool hole 53 than the two annular grooves 53*a* and 53*b*. In the communication position A, the annular space 57 is located between the second and third rounds 51*b* and 51*c* of the selector spool 51. The second round 51*b* is provided with a plurality of cuts 51*e*. The cuts 51*e* extend from an end surface of the second round 51*b* facing the first round 51*a* toward the other end surface of the second round 51*b* facing the third round 51*c*. In the communication position A, the cuts 51*e* are not open to the annular space 57 but are closed. Once the selector spool 51 moves a distance greater than a distance b upward from the communication position A, the cuts 51*e* are brought into communication with the annular space 57. As such, the annular space 57 and the annular groove 53*b* are brought into communication by causing the selector spool 51 to move a distance equal to or greater than the distance a upward from the communication position A.

In the spool hole 53, the portion that is closer to the proximal end than the annular space 57 and that is in the vicinity of the opening is larger in diameter than the rest (in particular, a distal end-side portion) of the spool hole 53. This larger diameter portion forms a spring enclosing space 58. The selector spool 51 projects from the distal end-side portion of the spool hole 53 into the spring enclosing space 58. The projecting proximal end-side portion of the selector spool 51 is provided with the round 51*c*. The round 51*c* moves in the up-down direction in the spring enclosing space 58. In the spool hole 53, the portion where the distal end-side portion and the spring enclosing space 58 are connected forms a valve seat 55. The third round 51*c* can be seated on the valve seat 55. More specifically, when the selector spool 51 is in the communication position A, the third round 51*c* is seated on the valve seat 55. The annular space 57 and the spring enclosing space 58 are disconnected by the third round 51*c* seated on the valve seat 55. Once the selector spool 51 moves from the communication position A to the open position B, the third round 51*c* is moved away from the valve seat 55. The annular space 57 and the spring enclosing space 58 are brought into communication as a result of the movement of the third round 51*c* away from the valve seat 55. The spool hole 53 is provided with a third annular groove 53*c* located in correspondence with the spring enclosing space 58. The third annular groove 53*c* communicates with the tank 19 via the first tank port 33*a*, tank communication path 48, and tank path 16 (see FIG. 2). Thus, once the selector spool 51 moves to the open position B, the annular groove 53*b* is brought into communication with the tank 19 via the plurality of cuts 51*e*, the annular space 57, and the spring enclosing space 58. This brings the spring chamber 45 into communication with the tank 19. As such, the tank pressure is introduced into the spring chamber 45.

The selector spool 51 configured as described above can move between the different positions to introduce either the pressure in the plunger chamber 44 or the tank pressure into the spring chamber 45. To be movable between the different positions, the selector spool 51 is configured as follows. The biasing spring 52 is mounted on the proximal end-side portion of the selector spool 51. The biasing spring 52 is a so-called compression coil spring. The biasing spring 52 is fitted around the proximal end-side portion of the selector spool 51. The biasing spring 52 fitted around the proximal end-side portion of the selector spool 51 is located between the third round 51*c* of the selector spool 51 and the ceiling surface of the cap member 54. The biasing spring 52 biases the selector spool 51 toward the communication position A.

The distal end of the selector spool 51 receives the first pilot pressure p1 introduced into the first pilot chamber 27*a*, and the first pilot pressure p1 acts against the biasing force of the biasing spring 52 described above. The distal end of the selector spool 51 projects from the spool hole 53 into the first pilot chamber 27*a*. Thus, the distal end of the selector spool 51 receives the first pilot pressure p1 introduced into the first pilot chamber 27*a*. As such, when the first pilot pressure p1 is introduced into the first pilot chamber 27*a* to lower the load 3, the selector spool 51 is pushed against the biasing force and moves a distance equal to or greater than the distance a upward from the communication position A. This allows the tank pressure to be introduced into the spring chamber 45. Thus, the plunger 41 is moved in the opening direction, so that the head-side path 18 is opened. In consequence, the hydraulic fluid flowing out of the head-side port 2*d* into the head-side path 18 is discharged into the tank 19 through the control valve 21 and tank path 16, and the rod 2*a* is retracted to lower the load 3.

When the load 3 is raised or held in a fixed position, the pressure in the first pilot chamber 27*a* is the tank pressure. Thus, the selector spool 51 is pushed by the biasing force and held in the communication position A. This allows the pressure in the plunger chamber 44 to be introduced into the spring chamber 45. Thus, once the main spool 31 is moved to the raising position U, the rod 2*a* is advanced to raise the load 3. Once the main spool 31 is returned to the neutral position M, supply and discharge of the hydraulic fluid to and from the head-side port 2*d* are precluded. Consequently, the load 3 can be held in a fixed position.

In the valve device 1 configured as described above, the selector spool 51 is located adjacent to the main spool 31. Further, the selector spool 51 has an axis L2 perpendicular to the axis L1 of the main spool 31. As such, the increase in the length of the valve device 1 in the axial direction of the main spool 31 (namely, the left-right direction) can be prevented. Additionally, since the selector spool 51 is located adjacent to the main spool 31, the increase in outer size in the perpendicular direction (namely, the up-down direction) can also be prevented. Consequently, the size of the valve device 1 can be reduced.

In the valve device 1, the selector spool 51 moves in response to the first pilot pressure p1 and thereby operates in conjunction with the movement of the main spool 31. This eliminates the need to construct a structure in which, as in the conventional control device, an end surface of the main spool 31 and an end surface of the selector spool 51 face each other and are pressed together to allow the spools to operate in conjunction with each other. In the valve device 1, the design flexibility of the selector spool 51 is high.

When, as in the conventional control device, the main spool and the selector spool are coaxially disposed and pressed together to allow the spools to operate in conjunction with each other, the stroke distance of the selector spool depends on the stroke distance of the main spool. Thus, the size of the selector itself must be increased to allow for the stroke distance as previously described. The size increase of the selector is one of the reasons for the size increase of the conventional control device. In contrast, in the valve device 1, the main spool 31 and the selector spool 51 are disposed in such a manner that their respective axes L1 and L2 are perpendicular to each other, and therefore the stroke distance of the selector spool 51 is not determined uniquely based on the stroke distance of the main spool 31. Thus, the design flexibility of the selector spool 51 is increased. This makes it possible to adjust the stroke distance of the selector spool 51 to reduce the size of the selector 23. Consequently, the size of the valve device 1 can be reduced.

The valve device 1 configured as described above further includes a manual operation mechanism 61 as shown in FIG. 2. In the valve device 1, the main spool 31 can be moved without outputting the pilot pressures p1 and p2. The manual operation mechanism 61 includes an operation pin 62, a shaft member 63, and an operation lever 64. The operation pin 62 is located in the first pilot chamber 27*a* of the spool cover 27. The operation pin 62 includes a pivoting portion 62*a* and a coupling portion 62*b*. The pivoting portion 62*a* is generally O-shaped. The shaft member 63 is fitted in the hole of the pivoting portion 62*a*. The pivoting portion 62*a* and the shaft member 63 are secured by a non-illustrated fixing pin in such a manner that the pivoting portion 62*a* and the shaft member 63 are not rotatable relative to each other. The shaft member 63 is disposed to have an axis L3 extending in a direction perpendicular to the axis L1 of the main spool 31. For example, the axis L3 extends in the front-back direction on the sheet plane of FIG. 2. The shaft member 63 is supported so as to be pivotable about the axis L3. The shaft member 63 projects from the spool cover 27 to the outside of the spool cover 27. The operation lever 64 is mounted on an end portion of the shaft member 63 that is located outside the spool cover 27. The operation lever 64 is not rotatable relative to the shaft member 63.

The operation lever 64 extends from the shaft member 63 in the radial direction of the shaft member 63. A grip portion 64*a* located at the upper end of the operation lever 64 can be manually operated to raise and lower the operation lever 64. Upon raising or lowering of the operation lever 64, the shaft member 63 and the operation pin 62 pivot about the axis L3. In the operation pin 62, the coupling portion 62*b* is integral with the pivoting portion 62*a*. The coupling portion 62*b* extends from the pivoting portion 62*a* in the radial direction of the pivoting portion 62*a*. The coupling portion 62*b* is coupled to the second axial end of the main spool 31. More specifically, the second axial end of the main spool 31 is provided with an insertion hole 31*g* extending in a direction perpendicular to the axis L1 of the main spool 31 and the axis L3 of the shaft member 63. For example, the insertion hole 31*g* extends in the up-down direction. The distal end of the coupling portion 62*b* is fitted in the insertion hole 31*g*.

In the manual operation mechanism 61 configured as described above, when the operation lever 64 is lowered as shown in FIG. 3A, the operation pin 62 pivots counterclockwise. Consequently, the main spool 31 is pulled leftward by the operation pin 62 and moved to the raising position U. When the operation lever 64 is raised as shown in FIG. 3B, the operation pin 62 pivots clockwise. Consequently, the main spool 31 is pushed rightward by the operation pin 62 and moved to the lowering position D. Thus, the main spool 31 of the control valve 21 can be moved to the raising position U and the lowering position D by the use of the manual operation mechanism 61.

In the valve device 1, the selector 23 is configured as follows in order that when the valve device 1 is manually operated, the selector 23 may be moved in conjunction with the movement of the main spool 31 without recourse to the first pilot pressure p1. The second end of the selector spool 51 extends toward the outer circumferential surface of the main spool 31. The outer circumferential surface of the main spool 31 is provided with a guide portion 39 located in correspondence with the selector spool 51. The guide portion 39 is larger in diameter than portions axially adjacent to the guide portion 39. A portion of the guide portion 39 that faces the second axial end of the main spool 31 is tapered toward the second axial end of the main spool 31. The tapered portion 39*a* is contacted by the distal end of the selector spool 51 when the main spool 31 is moved from the neutral position M to the lowering position D. As the main spool 31 is moved from the neutral position M to the lowering position D, the selector spool 51 moves along the tapered portion 39*a*; namely, the selector spool 51 is moved upward. Thus, the selector spool 51 can be moved from the communication position A to the open position B when the manual operation mechanism 61 is used to move the main spool 31 to the lowering position D, as in the case where the first pilot pressure p1 is introduced into the first pilot chamber 27*a* to move the main spool 31 to the lowering position D. That is, the pressure in the spring chamber 45 can be reduced to the tank pressure to allow the plunger 41 to complete a full stroke (see FIG. 3B) also when the valve device is manually operated, as in the case where the valve device is pilot-operated. Thus, the head-side path 18 is opened, and the rod 2*a* of the cylinder mechanism 2 is retracted to lower the load 3.

After passing over the tapered portion 39*a*, the selector spool 51 moves onto a holding portion of the guide portion 39. The holding portion 39*b* is generally circular in cross-section, and the outer diameter of the holding portion 39*b* is equal to the maximum outer diameter of the tapered portion 39*a*. Thus, after passing over the tapered portion 39*a*, the selector spool 51 can smoothly move onto the holding portion 39*b*. After moving onto the holding portion 39*b*, the selector spool 51 is held in the open position B regardless of the position of the main spool 31.

When the main spool 31 is returned from the lowering position D to the neutral position M, the selector spool 51 moves downward along the tapered portion 39*a*. After the main spool 31 has returned to the neutral position M, the selector spool 51 is in the communication position A. When the main spool 31 is moved from the neutral position M to the raising position U, the selector spool 51 is moved away from the tapered portion 39*a*. Thus, the selector spool 51 is not moved upward, but held in the communication position A. That is, when the valve device is manually operated, as in the case where the valve device is pilot-operated, the selector spool 51 can be held in the communication position A while the main spool 31 is in the neutral position M or raising position U. As such, when the main spool 31 is returned to the neutral position M after the manual operation, the head-side path 18 remains closed. This precludes discharge of the hydraulic fluid from the head-side port 2*d* into the tank 19, thereby allowing the load 3 to be held in a fixed position. When the main spool 31 is in the raising position U, the hydraulic pressure of the hydraulic fluid is applied to the plunger 41 to act against the pressure in the spring chamber 45 and the biasing force of the spring member 42. As shown in FIG. 3A, the plunger 41 moves to a position determined according to the flow rate of the hydraulic fluid passing through the lock valve 22.

In the valve device 1, as described above, the selector spool 51 is moved in conjunction with the position change of the main spool 31 also during manual operation. The valve device 1 can introduce either the pressure in the plunger chamber 44 or the tank pressure into the spring chamber 45 also when manually operated. Thus, the valve device 1 manually operated can operate in the same manner as when pilot-operated.

The valve device 1 described above is configured as follows in order to prevent the occurrence of shock when the load 3 is lowered by the cylinder mechanism 2. In particular, the valve device 1 is configured such that the relationship expressed by the following inequality (1) is established among the distance a, the distance b, a distance s, and a taper angle α.

$$a<b<s\times\tan\alpha \quad (1)$$

As previously mentioned, the distance a is the distance the selector spool has to move from the communication position A to disconnect the plunger chamber communication path 46 from the spring chamber communication path 47. As previously mentioned, the distance b is the distance the selector spool has to move from the communication position A to bring the annular space 57 and the annular groove 53*b* into communication. The distance s is the distance the main spool 31 moves from the neutral position M toward the lowering position D until at least one cut of the lowering-side flow rate control element 34*h* is brought into communication with the second larger diameter portion 32*b*. The taper angle α is the taper angle of the tapered portion 39*a*.

With the above relationship established among the distance a, the distance b, the distance s, and the taper angle α, the valve device 1 operates in the following manner. First, when the valve device 1 is manually operated to move the main spool 31 from the neutral position M toward the lowering position D, the plunger chamber communication path 46 and the spring chamber communication path 47 become disconnected because of the relationship a<b. Subsequently, the annular groove 53*b* and the annular space 57 are brought into communication, and the spring chamber communication path 47 becomes connected to the tank 19. Thus, the hydraulic fluid in the plunger chamber 44, namely the hydraulic fluid flowing out of the head-side port 2*d* of the cylinder mechanism 2, can be prevented from being discharged into the tank 19 through the annular path 56 and the annular space 57. As such, the flow path through which the hydraulic fluid is discharged can be limited to the head-side path 18. This can facilitate control of the flow rate of the hydraulic fluid to be discharged. Further, since the spring chamber communication path 47 is connected to the tank 19, the pressure in the spring chamber 45 is the tank pressure. Thus, the plunger 41 is pushed in the opening direction by the pressure in the plunger chamber 44, so that the head-side path 18 is opened.

Additionally, since there is the relationship a, b<s×tan α, the head port 33*b* and the first tank port 33*a* are brought into communication after the head-side path 18 is opened. Thus, the head-side path 18 and the tank 19 are brought into communication after the head-side path 18 is opened. In the early stage of the process in which the communication between the head port 33*b* and the first tank port 33*a* is established, these ports 33*b* and 33*a* are brought into communication via the lowering-side flow rate control element 34*h*. Thus, the flow rate of the hydraulic fluid flowing from the head-side path 18 into the tank 19 gradually increases. As such, the flow rate of the hydraulic fluid discharged from the head-side port 2*d* of the cylinder mechanism 2 into the tank 19 can be gradually increased. The shock occurring during the lowering of the load 3 can be reduced.

When returning the main spool 31 from the lowering position D to the neutral position M, the valve device 1 operates in a manner opposite to that described above. Thus, the occurrence of shock can be reduced also when the lowering of the load 3 is stopped.

Other Embodiments

While the valve device 1 of the above embodiment is typically used in a work machine, the entity to which the valve device is applicable is not limited to such machines. For example, the valve device may be used in a robot, an excavator, or a high place work vehicle which employs a hydraulic cylinder mechanism, and the fields to which the valve device is applicable are not limited to particular fields. The cylinder mechanism need not be a mechanism which raises and lowers the load, but may be configured to move the load horizontally.

While in the valve device 1 the main spool 31 is a pilot-operated spool, the main spool 31 may be an electrically operated spool such as that driven by an electric actuator. The operation lever 64 need not be always mounted on the shaft member 63. The operation lever 64 may be configured as a removable lever which can be mounted on the shaft member 63 as necessary.

While in the above embodiment the selector spool 51 is configured to operate in conjunction with the main spool 31 via the presence of the guide portion 39, the selector spool 51 is not limited to this configuration. In order for the selector spool 51 to operate in conjunction with the movement of the main spool 31, the selector spool 51 and the main spool 31 may be coupled by a link mechanism, or a cam mechanism or gear mechanism may be provided to enable power transmission between the spools. While in the valve device 1 the second end of the selector spool 51 is brought into contact with the guide portion 39, the portion to be brought into contact with the guide portion 39 is not limited to the second end of the selector spool 51. For example, a rod member may be provided to project from the selector spool 51 in a direction perpendicular to the axis of the selector spool 51, and the rod member may be brought into contact with the guide portion 39.

While in the valve device 1 of the above embodiment the selector spool 51 is disposed to extend in a direction perpendicular to the main spool 31, the selector spool 51 need not be disposed in this manner. The selector spool 51 only has to be disposed to extend in a direction crossing the main spool 31, and may, for example, be inclined with respect to the direction perpendicular to the main spool 31. That is, it is sufficient for the selector spool 51 to be disposed in such a manner that the distal end of the selector spool 51 can be moved by the tapered portion 39*a* in a direction against the biasing force of the biasing spring 52; thus, the selector spool 51 may be inclined with respect to the direction perpendicular to the main spool 31.

REFERENCE SIGNS LIST

1 valve device
2 cylinder mechanism
3 load
17 rod-side path (second supply/discharge path)
18 head-side path (first supply/discharge path)
18*a* main spool-side portion
18*b* head-side portion
19 tank
21 control valve
22 lock valve
23 selector
31 main spool
41 plunger
42 spring member
45 spring chamber (pressure chamber)
51 selector spool
64 operation lever

The invention claimed is:

1. A valve device that changes a direction of flow of a hydraulic fluid supplied to and discharged from a cylinder mechanism to actuate the cylinder mechanism, the valve device comprising:

a control valve comprising a main spool axially movable between different positions, the control valve being connected to the cylinder mechanism via a first supply/discharge path and a second supply/discharge path through which the hydraulic fluid is supplied to and discharged from the cylinder mechanism, the control valve being configured to, when the main spool has moved to a first position, allow the hydraulic fluid to be supplied to the cylinder mechanism through the first supply/discharge path and discharged into a tank through the second supply/discharge path, the control valve being further configured to, when the main spool has moved to a second position, allow the hydraulic fluid to be supplied to the cylinder mechanism through the second supply/discharge path and discharged into the tank through the first supply/discharge path, the control valve being further configured to, when the main spool has returned to a neutral position, block flow of the hydraulic fluid to the cylinder mechanism through the first and second supply/discharge paths;

a lock valve comprising a plunger disposed in the first supply/discharge path to open and close the first supply/discharge path, a biasing member biasing the plunger in a closing direction in which the plunger moves to close the first supply/discharge path, and a pressure chamber into which a pressure is introduced and which applies the introduced pressure to the plunger in the closing direction, wherein a hydraulic pressure of the hydraulic fluid flowing in a cylinder mechanism-side portion of the first supply/discharge path and a hydraulic pressure of the hydraulic fluid flowing in a control valve-side portion of the first supply/discharge path are applied to the plunger to act against a biasing force of the biasing member and the pressure applied by the pressure chamber, the cylinder mechanism-side portion being a portion closer to the cylinder mechanism than the plunger, the control valve-side portion being a portion closer to the control valve than the plunger; and a selector valve comprising a selector spool operable in conjunction with the main spool to axially move between different positions, the selector valve being configured to, when the main spool moves to the first position or the neutral position, move the selector spool to a holding position to bring the pressure chamber into communication with the cylinder mechanism-side portion of the first supply/discharge path to introduce a pressure of the cylinder mechanism-side portion into the pressure chamber, the selector valve being further configured to, when the main spool moves to the second position, move the selector spool to an open position to bring the pressure chamber into communication with the tank to introduce a tank pressure into the pressure chamber, the selector spool being located adjacent to the main spool and having an axis crossing an axis of the main spool.

2. The valve device according to claim 1, wherein the control valve is a pilot-operated spool valve and allows a first pilot pressure and a second pilot pressure to be applied to the main spool in such directions that the first and second pilot pressures act against each other, the main spool moves to the second position upon receiving the first pilot pressure and moves to the first position upon receiving the second pilot pressure, and the selector spool operates in conjunction with the main spool by receiving the first pilot pressure and moving to a position determined according to the first pilot pressure.

3. The valve device according to claim 1, wherein the main spool has an outer circumferential portion provided with a tapered portion tapered toward a second axial end of the main spool, a portion of the selector spool is adjacent to the outer circumferential portion of the main spool, the portion of the selector spool is in contact with the tapered portion when the main spool is moved from the neutral position to the second position, and the tapered portion allows the selector spool to move from the holding position to the open position when the main spool is moved from the neutral position to the second position with the portion of the selector spool in contact with the tapered portion.

4. The valve device according to claim 3, further comprising an operation lever coupled to the main spool and operated to move the main spool from the neutral position to the first position and the second position.

5. The valve device according to claim 4, wherein the main spool is configured to, when moving from the neutral position to the second position, establish a connection between the first supply/discharge path and the tank after the pressure chamber and the tank are brought into communication.

6. The valve device according to claim 3, wherein the selector spool is configured to, when moving from the holding position to the open position, establish a connection between the pressure chamber and the tank after the pressure chamber and the cylinder mechanism-side portion of the first supply/discharge path are disconnected.

* * * * *